US006105911A

United States Patent [19]

Olexson

[11] Patent Number: 6,105,911

[45] **Date of Patent: *Aug. 22, 2000**

[54] LADDER CADDY APPARATUS

[76] Inventor: Steve Olexson, 3670 N. Delaware Dr., Easton, Pa. 18040

[ * ] Notice: This patent issued on a continued prosecution application filed under 37 CFR 1.53(d), and is subject to the twenty year patent term provisions of 35 U.S.C. 154(a)(2).

[21] Appl. No.: 09/123,891

[22] Filed: Jul. 28, 1998

[51] Int. Cl.[7] ..... E06C 7/14

[52] U.S. Cl. ..... 248/211; 248/210

[58] Field of Search ..... 248/210, 211, 248/214, 309.1, 339, 304, 215; 182/129, 121, 122

[56] References Cited

U.S. PATENT DOCUMENTS

| | | | |
|---|---|---|---|
| 1,243,732 | 10/1917 | Goss | 248/210 |
| 2,033,497 | 3/1936 | Victor | 182/61 |
| 2,308,805 | 1/1943 | Dahl | 248/211 |
| 2,318,930 | 5/1943 | Dietrich | 211/119 |
| 2,503,108 | 4/1950 | Glandville | 248/211 |
| 2,508,258 | 5/1950 | Heinrich | 248/210 |
| 2,703,215 | 3/1955 | Weiss | 248/210 |
| 3,154,282 | 10/1964 | Monson | 248/211 |
| 3,313,506 | 4/1967 | Bauchard | 248/210 |
| 4,099,693 | 7/1978 | Blann | 248/210 |
| 4,186,903 | 2/1980 | Fazakerley | 248/210 |
| 4,702,446 | 10/1987 | Brown | 248/210 |
| 5,031,723 | 7/1991 | Hooten | 182/129 |
| 5,181,682 | 1/1993 | Indelicato | 248/210 |
| 5,649,682 | 7/1997 | Martin | 248/210 |
| 5,687,941 | 11/1997 | Quintile | 248/210 |

*Primary Examiner*—Leslie A. Braun
*Assistant Examiner*—Gwendolyn Baxter

[57] ABSTRACT

A ladder caddy apparatus includes a rung hook portion which includes an upper hook region and a lower hook region. A rail bracket assembly is connected to the lower hook region, and an item-support assembly is connected to the rail bracket assembly. A rear portion of the upper hook region extends behind the lower hook region. The rail bracket assembly extends behind the lower hook region. The lower hook region and a front portion of the rail bracket assembly are coplanar. The upper hook region and the lower hook region extend along a longitudinal hook axis. The item-support assembly extends along an item-support axis. The longitudinal hook axis and the item-support axis are perpendicular to one another. The rail bracket assembly includes a rail-reception bracket, and a screw clamp assembly is attached to the rail-reception bracket. The item-support assembly includes a support strut connected to the rail bracket assembly. The support strut includes an upwardly curved distal strut end. The item-support assembly includes an item hook and a pivotal support assembly attached to the support strut. With a right-sided embodiment of the invention, the rail bracket assembly is to the right of the rung hook portion and is connected to a right ladder rail. With a left-sided embodiment of the invention, the rail bracket assembly is to the left of the rung hook portion and is connected to a left ladder rail.

15 Claims, 3 Drawing Sheets

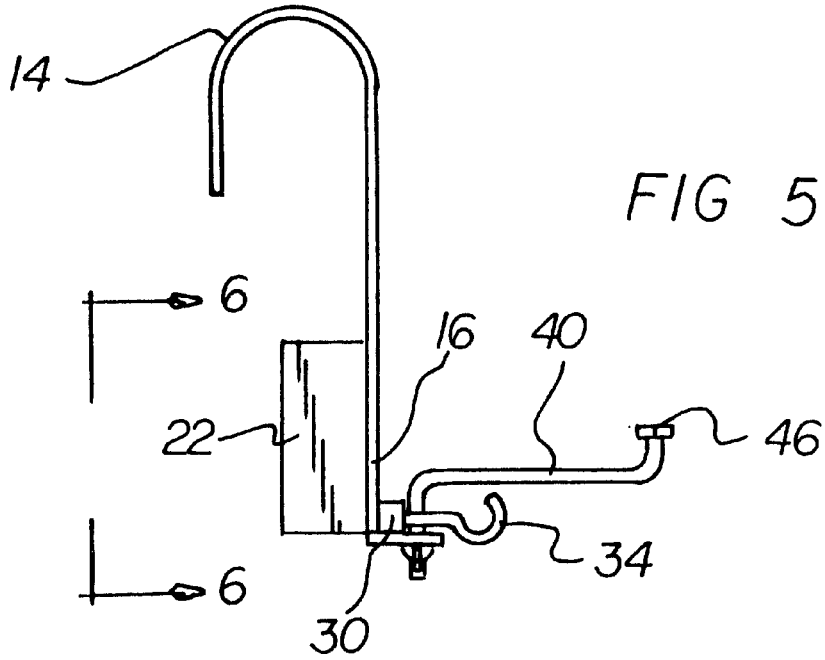
FIG 5
FIG 6
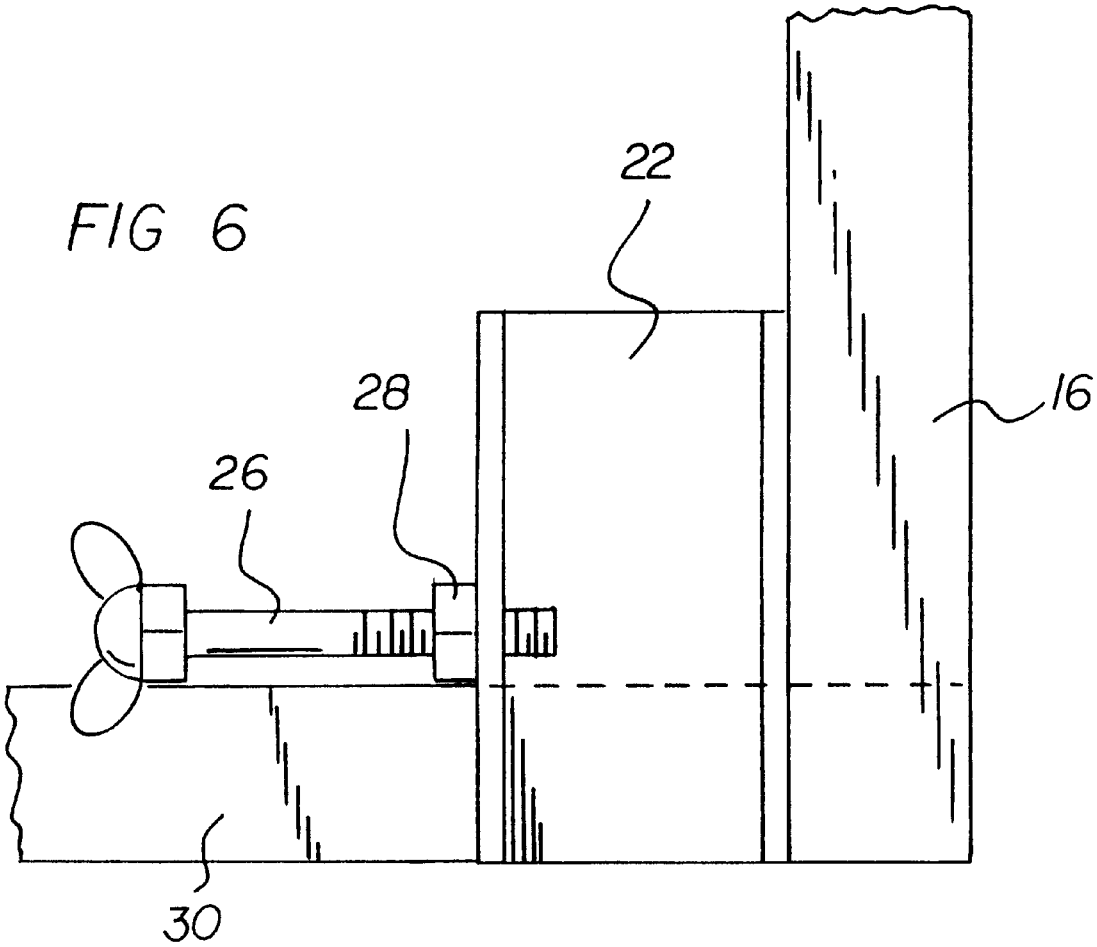

LADDER CADDY APPARATUS

BACKGROUND OF THE INVENTION

1. Field of the Invention

The present invention relates generally to attachments to ladders and, more particularly, to ladder attachments especially adapted for retaining paint cans, brushes, and other items used by a person using a ladder.

2. Description of the Prior Art

When a person has climbed a ladder, the person often needs to bring a number of items with one up the ladder. For example, when the person is doing painting, the person must bring up a paint can and a paint brush. Moreover, there are times when the person uses such items while up the ladder, and there are other times when the person needs one hands free for other items, and such items brought up the ladder must be relinquished from one's hands. In this regard, throughout the years, a number of innovations have been developed relating to retaining items that are carried up a ladder, and the following U.S. patents are representative of some of those innovations: U.S. Pat. Nos. 4,099,693, 4,186,903, 4,702,446, 5,181,682, and 5,649,682. More specifically, each of U.S. Pat. Nos. 4,099,693, 4,186,903, 4,702,446, and 5,649,682 discloses a ladder-mounted device for holding a paint can, wherein the ladder-mounted is supported by the ladder by extending a portion of the ladder-mounted device into a hollow ladder rung. Not all ladders have hollow rungs. Therefore, ladder-mounted devices that use hollow ladder rungs cannot be used with all ladders. In this respect, it would be desirable if a ladder-mounted, paint can retention device does not require the use of hollow ladder rungs.

U.S. Pat. No. 5,181,682 discloses a tool holder that employs a mounting that employs a hollow ladder rung. For the reasons stated above, it would be desirable if a ladder-mounted tool holder were provided that does not employ hollow ladder rungs.

Still other features would be desirable in a ladder caddy apparatus. In this respect it is noted that a ladder is comprised of two rails and a number of rungs. In general, the rails must be stronger than the rungs. This being the case, it would be desirable if a ladder-mounted, item retention device were provided that uses rails on ladders for a portion of their support.

Nevertheless, aside from using a ladder rail for support, it would also be desirable to make use of the outside surfaces of rungs of ladders for support. Because rungs extend horizontally, the outside surfaces of rungs are generally easy to hang items from.

At times, it would be desirable to be able to support a relatively long item on a ladder in a horizontal orientation. For example, when a ladder is used elevating a person for installing a long piece of lumber at a horizontal orientation on an elevated portion of a house, it would be desirable if the ladder could support such a long piece of lumber in a horizontal orientation.

In addition, when a ladder is used for holding items, special attention should be paid to assure that items stored on the ladder do not fall off the ladder. Items which fall off the ladder can be dangerous to persons below. Moreover, the person on the ladder may have to climb down the ladder to retrieve fallen items.

Thus, while the foregoing body of prior art indicates it to be well known to use ladders to support a number of items, the prior art described above does not teach or suggest a ladder caddy apparatus which has the following combination of desirable features: (1) provides a ladder-mounted, paint can retention device which does not require the use of hollow ladder rungs; (2) provides a ladder-mounted tool holder that does not employ hollow ladder rungs; (3) uses rails on ladders for a portion of their support; (4) uses the outside surfaces of rungs of ladders for support; (5) can support a long piece of lumber in a horizontal orientation; and (6) helps prevent items stored on the ladder from falling off the ladder. The foregoing desired characteristics are provided by the unique ladder caddy apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a ladder caddy apparatus which includes a rung hook portion which includes an upper hook region and a lower hook region. A rail bracket assembly is connected to the lower hook region, and an item-support assembly is connected to the rail bracket assembly. A rear portion of the upper hook region extends behind the lower hook region. The rail bracket assembly extends behind the lower hook region. The lower hook region and a front portion of the rail bracket assembly are coplanar. The upper hook region and the lower hook region extend along a longitudinal hook axis. The item-support assembly extends along an item-support axis. The longitudinal hook axis and the item-support axis are perpendicular to one another.

The rail bracket assembly includes a rail-reception bracket, and a screw clamp assembly is attached to the rail-reception bracket. The screw clamp assembly includes a lock bolt and a lock nut supported by the lock bolt.

The item-support assembly includes a support strut connected to the rail bracket assembly. The support strut includes an upwardly curved distal strut end. The item-support assembly includes an item hook attached to the support strut.

The item-support assembly includes a pivotal support assembly attached to the support strut. The pivotal support assembly includes a pivot base member connected to the support strut. The pivot base member includes a base reception channel. A movable support member is pivotally connected to the pivot base member. The movable support member includes a threaded member portion which is received in the base reception channel and extends out from the base reception channel. A support-member lock nut is received on the threaded member portion of the movable support member. The movable support member includes an upturned distal end.

With a right-sided embodiment of the invention, the rail bracket assembly is to the right of the rung hook portion and is connected to a right ladder rail. With a left-sided embodiment of the invention, the rail bracket assembly is to the left of the rung hook portion and is connected to a left ladder rail.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ladder caddy apparatus which has all of the advantages of the prior art and none of the disadvantages.

It is another object of the present invention to provide a new and improved ladder caddy apparatus which may be easily and efficiently manufactured and marketed.

It is a further object of the present invention to provide a new and improved ladder caddy apparatus which is of durable and reliable construction.

An even further object of the present invention is to provide a new and improved ladder caddy apparatus which is susceptible of a low cost of manufacture with regard to both materials and labor, and which accordingly is then susceptible of low prices of sale to the consuming public, thereby making such ladder caddy apparatus available to the buying public.

Still yet a further object of the present invention is to provide a new and improved ladder caddy apparatus which provides a ladder-mounted, paint can retention device which does not require the use of hollow ladder rungs.

Still another object of the present invention is to provide a new and improved ladder caddy apparatus that provides a ladder-mounted tool holder that does not employ hollow ladder rungs.

Yet another object of the present invention is to provide a new and improved ladder caddy apparatus which uses rails on ladders for a portion of their support.

Even another object of the present invention is to provide a new and improved ladder caddy apparatus that uses the outside surfaces of rungs of ladders for support.

Still a further object of the present invention is to provide a new and improved ladder caddy apparatus which can support a long piece of lumber in a horizontal orientation.

Yet another object of the present invention is to provide a new and improved ladder caddy apparatus that helps prevent items stored on the ladder from falling off the ladder.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an end view of the embodiment of the invention shown in FIG. 3 taken along line 5—5 thereof.

FIG. 6 is an enlarged partial end view of the embodiment of the invention shown in FIG. 5 taken along line 6—6 thereof.

DESCRIPTION OF THE PREFERRED EMBODIMENT

With reference to the drawings, a new and improved ladder caddy apparatus embodying the principles and concepts of the present invention will be described.

Figure 1:
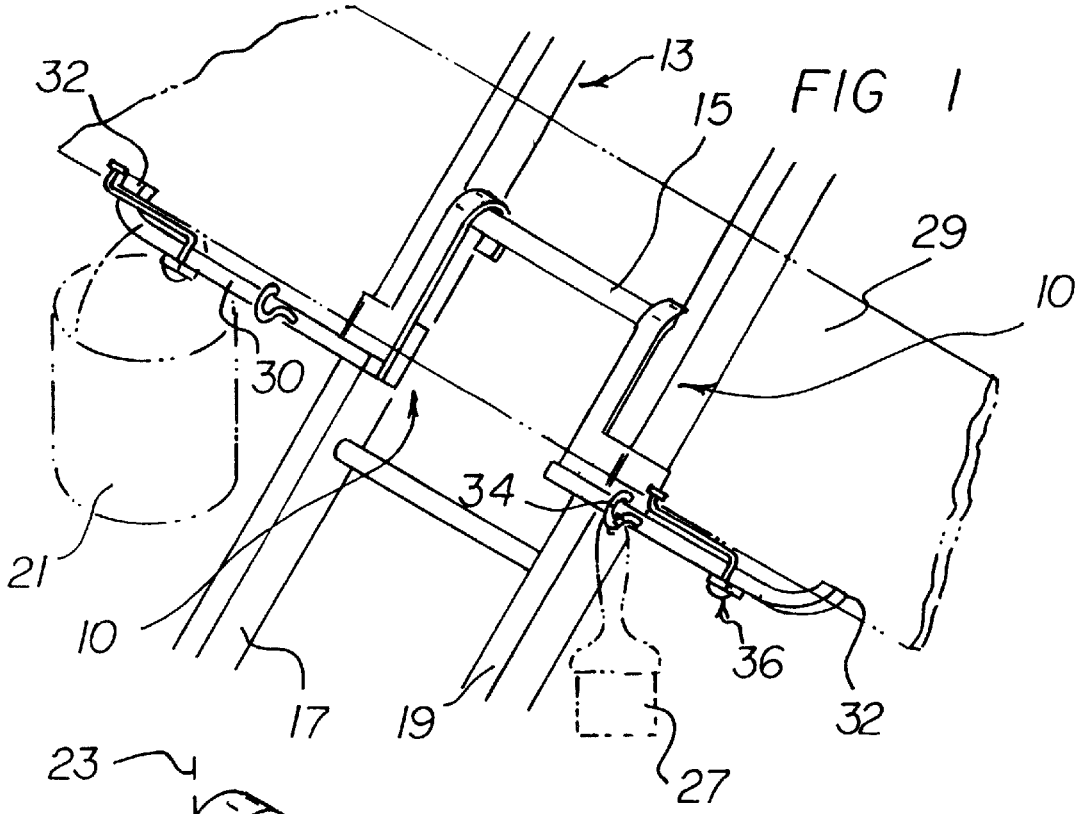
FIG. 1 is a perspective view showing a pair of preferred embodiments of the ladder caddy apparatus of the invention in use on a ladder.
Figure 2:
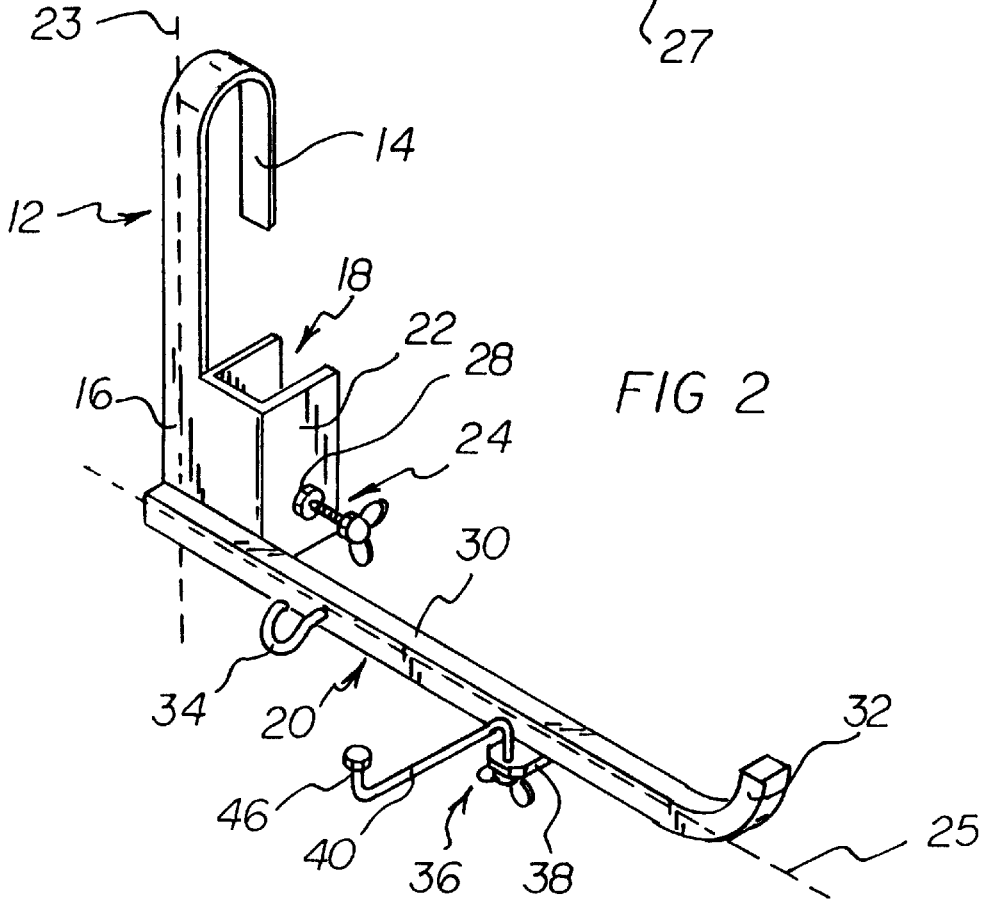
FIG. 2 is an enlarged perspective view of the right-side embodiment of the ladder caddy apparatus shown in FIG. 1 removed from the ladder.
Figure 3:
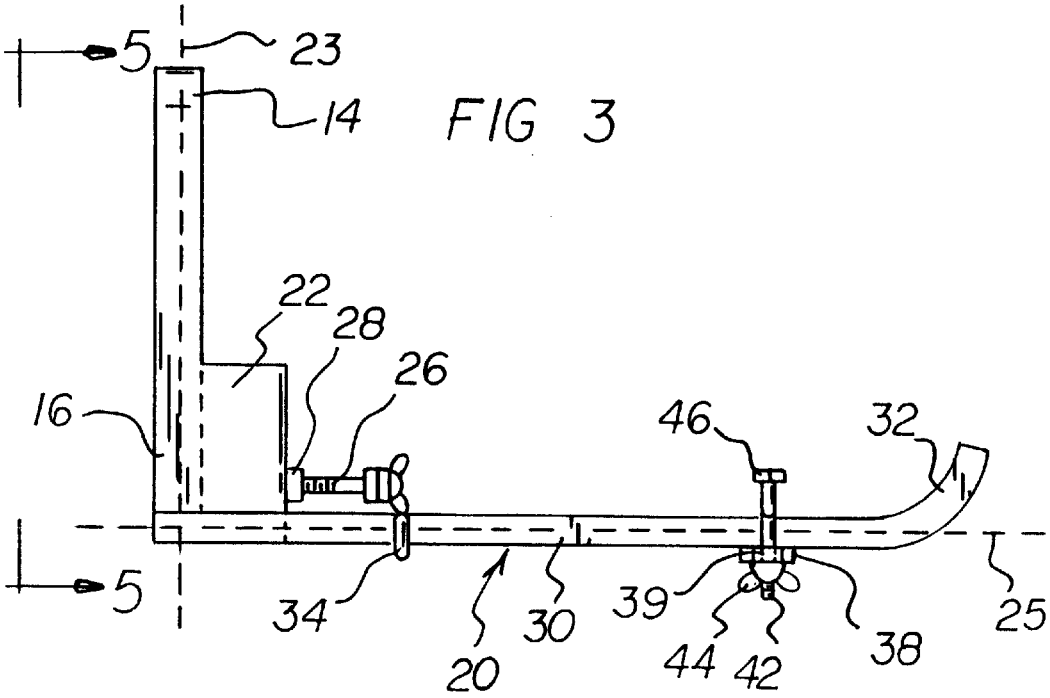
FIG. 3 is a front view of the embodiment of the ladder caddy apparatus of FIG. 2.
Figure 4:
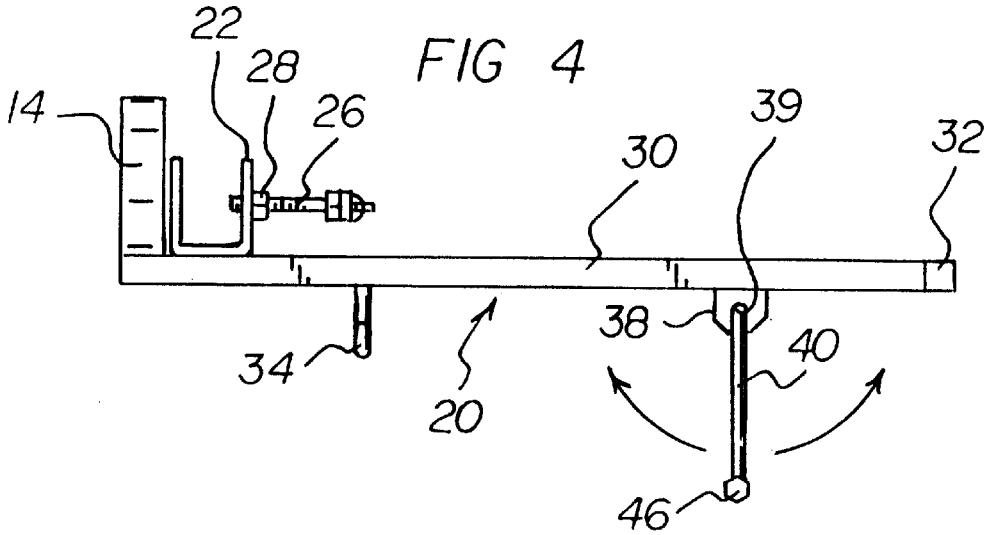
FIG. 4 is a top view of the embodiment of the invention shown in FIG. 2.

Turning to FIGS. 1–6, a right-sided embodiment of the ladder caddy apparatus of the invention is shown and is generally designated by reference numeral 10. A left-sided embodiment of the invention is also shown in FIG. 1. With either the right-sided embodiment of the invention or the left-sided embodiment of the invention, the ladder caddy apparatus 10 includes a rung hook portion 12 which includes an upper hook region 14 and a lower hook region 16. A rail bracket assembly 18 is connected to the lower hook region 16, and an item-support assembly 20 is connected to the rail bracket assembly 18. A rear portion of the upper hook region 14 extends behind the lower hook region 16. The rail bracket assembly 18 extends behind the lower hook region 16. The lower hook region 16 and a front portion of the rail bracket assembly 18 are coplanar. The upper hook region 14 and the lower hook region 16 extend along a longitudinal hook axis 23. The item-support assembly 20 extends along an item-support axis 25. The longitudinal hook axis 23 and the item-support axis 25 are perpendicular to one another.

The rail bracket assembly 18 includes a rail-reception bracket 22, and a screw clamp assembly 24 is attached to the rail-reception bracket 22. The screw clamp assembly 24 includes a lock bolt 26 and a lock nut 28 supported by the lock bolt 26.

The item-support assembly 20 includes a support strut 30 connected to the rail bracket assembly 18. The support strut 30 includes an upwardly curved distal strut end 32. The item-support assembly 20 includes an item hook 34 attached to the support strut 30.

The item-support assembly 20 includes a pivotal support assembly 36 attached to the support strut 30. The pivotal support assembly 36 includes a pivot base member 38 connected to the support strut 30. The pivot base member 38 includes a base reception channel 39. A movable support member 40 is pivotally connected to the pivot base member 38. The movable support member 40 includes a threaded member portion 42 which is received in the base reception channel 39 and extends out from the base reception channel 39. A support-member lock nut 44 is received on the threaded member portion 42 of the movable support member 40. The movable support member 40 includes an upturned distal end 46.

With a right-sided embodiment of the invention, the rail bracket assembly 18 is to the right of the rung hook portion 12. With a left-sided embodiment of the invention, the rail bracket assembly 18 is to the left of the rung hook portion 12.

In FIG. 1, a ladder 13 is shown which has plurality of rungs 15 and a left ladder rail 17 and a right ladder rail 19. A right-sided embodiment of the invention is shown on the right ladder rail 19, and a left-sided embodiment of the invention is shown on the left ladder rail 17. For the right-sided embodiment of the invention, the respective rail bracket assembly 18 is connected to the right ladder rail 19. For the left-sided embodiment of the invention, the respective rail bracket assembly 18 is connected to the left ladder rail 17. The respective rung hook portions 12 of the right-sided embodiment of the invention and the left-sided embodiment of the invention are hung on the same rung 15.

In FIG. 1, a paint can 21 is suspended from the support strut 30 of the left-sided embodiment of the invention. The upwardly curved distal strut end 32 helps prevent the paint can 21 from sliding off of the respective support strut 30. A paint brush 27 is suspended from an item hook 34 on the right-sided embodiment of the invention.

A long board 29 is supported by both the right-sided embodiment of the invention and the left-sided embodiment of the invention. More specifically, the movable support member 40 of the pivotal support assembly 36 on the right-sided embodiment of the invention is pivoted outward with respect to the support strut 30 of the right-sided embodiment of the invention. Similarly, the movable support member 40 of the pivotal support assembly 36 on the left-sided embodiment of the invention is pivoted outward with respect to the support strut 30 of the left-sided embodiment of the invention. In this respect, the bottom edge of the long board 29 rests on both the movable support member 40 on the right-sided embodiment of the invention and the movable support member 40 on the left-sided embodiment of the invention. Also, the back side of the long board 29 rests on front side of the respective rung hook portions 12 of both the right-sided embodiment of the invention and the left-sided embodiment of the invention.

For each of the right-sided embodiment of the invention and the left-sided embodiment of the invention, to install the respective rail bracket assembly 18 on the respective ladder rail the lock bolt 26 is loosened to allow the rail-reception bracket 22 to fit onto the ladder rail. Then, the lock bolt 26 is tightened so that the lock bolt 26 clamps the ladder rail in the rail-reception bracket 22. Then, the respective lock nut 28 is tightened. Conversely, to remove the ladder caddy apparatuses 10 of the invention from the ladder 13, the respective lock nut 28 is loosened, the respective lock bolt 26 is loosened, and the respective rung hook portion 12 is lifted off of the respective supporting rung 15.

For each of the right-sided embodiment of the invention and the left-sided embodiment of the invention, the respective movable support member 40 of a pivotal support assembly 36 can be locked into a desired position by tightening the support-member lock nut 44 on the threaded member portion 42 of the movable support member 40. Conversely, the movable support members 40 are easily rotated with respect to the base reception channels 39 by loosening the support-member lock nuts 44.

The components of the ladder caddy apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved ladder caddy apparatus that is low in cost, relatively simple in design and operation, and which may advantageously be used to provide a ladder-mounted, paint can retention device which does not require the use of hollow ladder rungs. With the invention, a ladder caddy apparatus provides a ladder-mounted tool holder that does not employ hollow ladder rungs. With the invention, a ladder caddy apparatus is provided which uses rails on ladders for a portion of their support. With the invention, a ladder caddy apparatus is provided which uses the outside surfaces of rungs of ladders for support. With the invention, a ladder caddy apparatus is provided which can support a long piece of lumber in a horizontal orientation. With the invention, a ladder caddy apparatus is provided which helps prevent items stored on the ladder from falling off the ladder.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A ladder caddy apparatus for use with a ladder having a multiplicity of spaced rungs disposed between a pair of spaced rails, said ladder caddy apparatus comprising:

a rung hook portion which includes an upper hook region and a lower hook region, a rail bracket assembly connected to said lower hook region, and an item-support assembly, said item support assembly having a proximal end portion and a distal end portion, said proximal end portion being connected to both said rail bracket assembly and said lower hook region of said rung hook portion, said rail bracket assembly having a pair of opposed, spaced sidewalls and a base member connected between said pair, said pair of opposed, spaced sidewalls extending substantially orthogonally from said base member, said base member providing a first support surface for said item-support assembly proximal end portion, said lower hook region of said hook portion providing a second support surface for said item-support assembly proximal end portion, said first support surface and said second support surface being co-planar with respect to each other, such that when the upper hook region of said apparatus engages at least one of said multiplicity of rungs on said ladder, said pair of opposed, spaced sidewalls of said rail bracket assembly is adapted to engage the rail portion of said ladder proximal to said at least one rung with said proximal rail portion being received between said pair of opposed, spaced sidewalls, and said distal end portion of said item-support assembly extends longitudinally in a direction substantially parallel to the common plane including said first and second co-planar support surfaces.

2. The apparatus of claim 1 wherein a rear portion of said upper hook region extends behind said lower hook region.

3. The apparatus of claim 1 wherein said rail bracket assembly extends behind said lower hook region.

4. The apparatus of claim 1 wherein said lower hook region and a front portion of said rail bracket assembly are coplanar.

5. The apparatus of claim 1 wherein said upper hook region and said lower hook region extend along a longitudinal hook axis.

6. The apparatus of claim 5 wherein said item-support assembly extends along an item-support axis.

7. The apparatus of claim 6 wherein said longitudinal hook axis and said item-support axis are perpendicular to one another.

8. The apparatus of claim 1 wherein said rail bracket assembly includes:

screw clamp assembly attached to said rail-reception bracket, said screw clamp assembly being disposed on one of said pair of opposed, spaced sidewalls.

9. The apparatus of claim 8 wherein said screw clamp assembly includes a lock bolt and a lock nut supported by said lock bolt.

10. The apparatus of claim 1 wherein said item-support assembly includes:

a support strut connected to said rail bracket assembly.

11. The apparatus of claim 10 wherein said support strut includes an upwardly curved distal strut end.

12. The apparatus of claim 10 wherein said item-support assembly includes an item hook attached to said support strut.

13. The apparatus of claim 10 wherein said item-support assembly includes a pivotal support assembly attached to said support strut.

14. The apparatus of claim 13 wherein said pivotal support assembly includes:

a pivot base member connected to said support strut, wherein said pivot base member includes a base reception channel, a movable support member pivotally connected to said pivot base member, wherein said movable support member includes a threaded member portion which is received in said base reception channel and extends out from said base reception channel, and a support-member lock nut received on said threaded member portion of said movable support member.

15. The apparatus of claim 14 wherein said movable support member includes an upturned distal end.

* * * * *